United States Patent [19]

Bowers

[11] 3,997,289

[45] Dec. 14, 1976

[54] CERAMIC WARE

[75] Inventor: Edward Carryer Bowers, Newcastle, England

[73] Assignee: Staffordshire Potteries (Holdings) Limited, Stoke-on-Trent, England

[22] Filed: June 19, 1975

[21] Appl. No.: 588,318

[30] Foreign Application Priority Data

June 25, 1974 United Kingdom ..... 28065/74

[52] U.S. Cl. ..... 432/241; 432/258; 432/259; 264/58

[51] Int. Cl.[2] ..... F27D 3/12; F27D 5/00

[58] Field of Search ..... 432/241, 251, 253, 258, 432/259, 245, 5, 6; 264/57–59; 269/289, 321 ME; 248/19, DIG. 1; 165/67, 68

[56] References Cited

UNITED STATES PATENTS

| | | | |
|---|---|---|---|
| 1,386,012 | 8/1921 | Meehan | 432/241 |
| 1,641,185 | 9/1927 | Meehan | 432/241 |
| 1,846,614 | 2/1932 | Rowland | 432/253 |
| 1,903,119 | 3/1933 | Ladd | 432/258 |
| 2,897,571 | 8/1959 | Kupchinsky et al. | 432/259 |
| 3,037,889 | 6/1962 | Nystrom | 432/5 |
| 3,179,724 | 4/1965 | Jones | 432/5 |
| 3,266,116 | 8/1966 | Rush | 432/259 |
| 3,904,352 | 9/1975 | Thurnauer et al. | 432/5 |

FOREIGN PATENTS OR APPLICATIONS

| | | | |
|---|---|---|---|
| 84,396 | 10/1957 | Denmark | 432/259 |

*Primary Examiner*—John J. Camby
*Assistant Examiner*—Henry C. Yuen
*Attorney, Agent, or Firm*—Marshall & Yeasting

[57] ABSTRACT

A kiln car has a wheeled base and a superstructure supported above the base, the superstructure comprising a number of tiers of refractory batts supported one tier above the other by a series of props. At least the lowermost tier of batts is supported on at least some of the props through the agency of discs which each have a convex or domed face so as to make point contact either with a batt or the supporting face of the respective prop.

5 Claims, 6 Drawing Figures

CERAMIC WARE

BACKGROUND OF THE INVENTION

This invention relates to ceramic ware, and more specifically to the firing of the same.

It is conventional practice with certain types of kilns to load the ware onto cars which are progressed through the kiln to effect the firing, and it is necessary to support the ware on the cars to avoid damage to the ware which is particularly vulnerable whilst in the unfired condition.

The ceramic articles are usually supported on appropriately shaped shelves known in the art as batts, and the batts are spaced one above the other with props between them arranged in vertically aligned series. The lowermost batts are spaced above the base of the car by special props known as mid-feathers. All of the batts and props are made of refractory materials, and the base of the car is also provided with a refractory structure.

In the interests of stability it is accepted practice to bed the bottom tier of batts onto the top of the mid-feathers with cement or fireclay, although they can be placed dry. The other tiers of batts above the base tier are supported by cylindrical refractory props (usually tubular); these are normally mated dry to a recessed or embossed cap or disc below and above each prop. These caps or discs can be cemented to the props, but batts are usually dry placed to facilitate ease of replacement.

In use the loaded car is moved at least into and out of the kiln and possibly also progressed through the kiln, and may be subject to physical shock, for example from one car bumping into another, or other shock transmitted through the car wheels. It is also subject to thermal shock, and the complete structure undergoes differential expansion and contraction. Consequently the batts often crack and break and although this may not initially lead to collapse of the structure, it is considered necessary to effect repairs, for example inserting additional props or replacing cracked batts, because of the fear that the structure may collapse and not only damage the load of ware, but jam the kiln so as possibly to necessitate the kiln being shut down whilst the car is removed. As a result, the costs of maintaining the cars and their structure is high, and it is the object of the present invention to provide improvements which will reduce this cost.

SUMMARY OF THE INVENTION

In accordance with the invention we provide a kiln car, the super-structure of which comprises at least one fulcrum provided between the lowermost batt or tier of batts and the car base.

The mechanism of the invention is to allow differential expansion and contraction between different points of the superstructure, thus allowing slight adjusting movements to take place and hence avoiding or at least substantially reducing breakage and damage, without introducing any substantial instability.

Preferably the lowermost batt is provided with a separate fulcrum between it and each of its supporting props. Preferably each fulcrum is constituted by a single disc having a domed face arranged to contact either a batt or a mid-feather.

Each fulcrum may be provided by a pair of discs or like plates one of which may be cemented for example to the top of a prop and the other of which is located below the underside of a batt, and these discs meet face-to-face and are axially aligned at least when the superstructure is first built; at least one of the discs having a domed and preferably part-spheroidal face. The domed face may be located downwardly and the other discs have an upper flat face, or vice versa, or both may be domed.

The discs are to be made of refractory material capable of withstanding the physical loads involved and kiln temperatures, thermal shocks ( e.g. burner flame impingement) and the various atmospheres to which the structure is subject in use, but the provision of the discs to form the fulcrums enable several distinct types or grades of refractory material to be used for the different parts of the superstructure, according to the requirements for each part, without making the same unduly expensive.

Thus, the mid-feathers, which take a greater weight than the other props and are subject to flame impingement may be made of a coarser and softer grade of refractory, because the load is applied thereto substantially entirely as compressive load applied axially. The batts require to support relatively light loads (of the ware thereon) between the props, and transmit heavier loads via the props. In general then the batts will need to be of a finer and denser grade of refractory.

The discs may be of an even finer and denser grade of refractory (than the batts) or of the same grade as the batts so that they present smooth surfaces towards one another and can support the not inconsiderable weights of the superstructure and its load over areas which theoretically at least amount to point contacts without one disc embedding in the other. The small areas of contact result in higher loadings and can therefore contribute to stability.

The invention may be utilised between each of the successive tiers of batts, although in general a kiln user will be aware of which of the successive tiers are most frequently subject to damage with particular workloads and it will only be necessary to use the invention for such tiers.

In a typical application of the invention the discs are about 3 inches across and ⅝ inch thick, the domed one being about ⅛ inch more at its axis than at its rim. The discs may be made by dry-pressing an alumina silicate having an alumina content of about 42% for example. This may be contrasted with a typical mid-feather made of fireclay, or of alumina silicate with a lower alumina content, e.g. 38%.

BRIEF DESCRIPTION OF THE PREFERRED EMBODIMENT

DESCRIPTION OF THE PREFERRED EMBODIMENT

Figure 1:
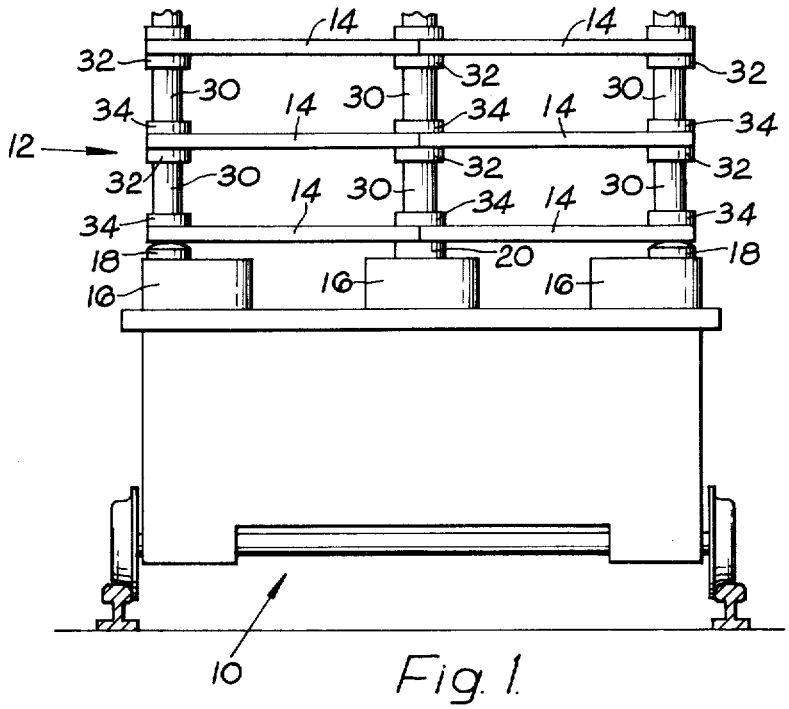
FIG. 1 is an end view of a kiln car embodying the invention.
Figure 2:
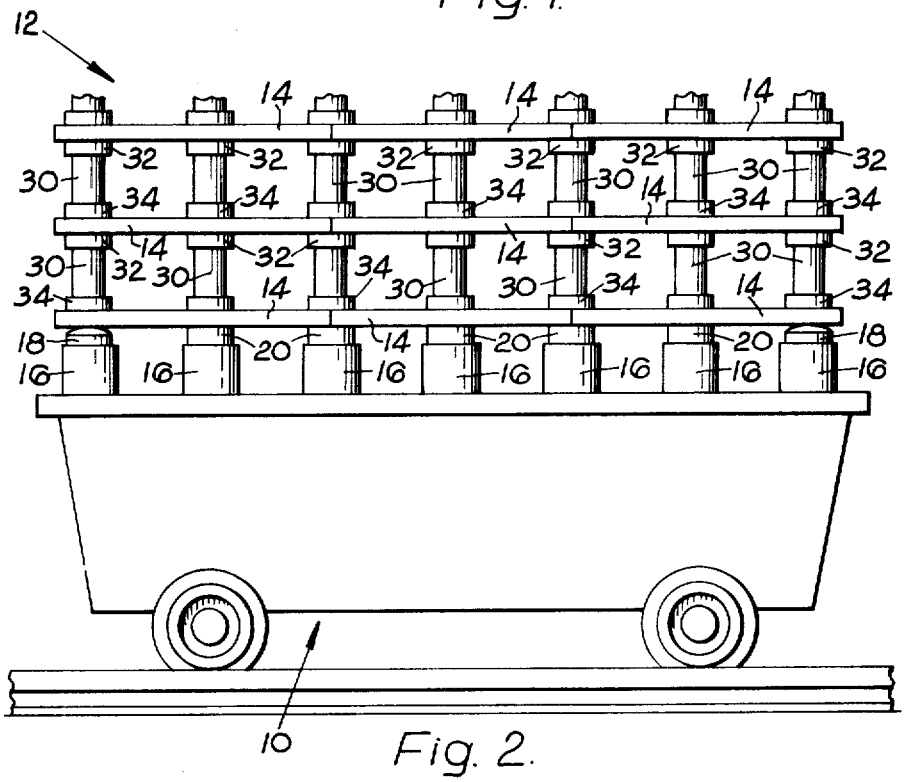
FIG. 2 is a side view of the kiln car of FIG. 1.
Figure 3:
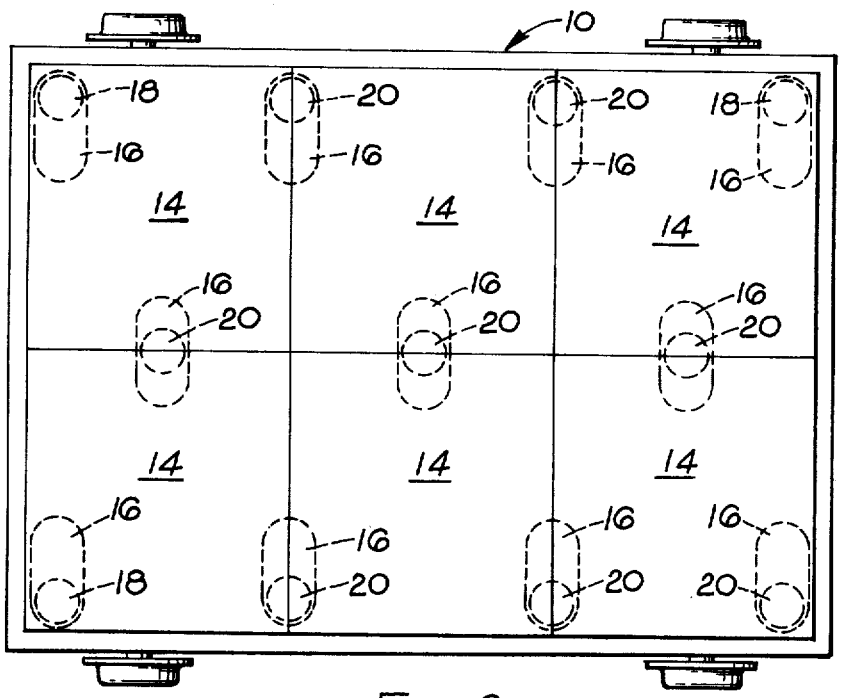
FIG. 3 is a plan view of the kiln car of FIG. 1 with all except the lowermost tier thereof removed.

The kiln car illustrated diagrammatically in FIGS. 1 and 3 comprises a wheeled base 10, which is constructed from refractory in conventional manner, and a superstructure 12 supported above the base 10. The superstructure comprises a number of tiers of refractory batts 14, there being six batts in each tier in the illustrated embodiments arranged in two side by side rows with three batts in each row placed end to end relative to one another. There may of course be more or less batts in each tier than shown in the illustrated embodiment.

The first or lowermost tier is supported from the base 10 of the car by three longitudinal rows of props 16, known as mid-feathers in the art, there being three props 16 in the middle row and four props 16 in the two side rows, the props 16 in the middle row being offset or staggered relative to those in the two side rows. It will be noted on FIG. 3 that each batt 14 is provided with three point support, namely at two corners thereof and at the mid-point of the side opposite said two corners.

Figure 4:
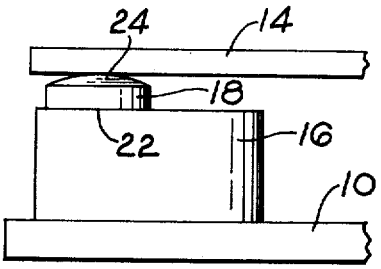
FIG. 4 is a fragmentary enlarged view showing the fulcrum provided between the first tier and a mid-feather.

Between each prop 16 and the lowermost tier of batts, there is provided a disc 18 or 20 of refractory material. In the illustrated embodiment each disc 20 has flat parallel faces but the discs 18, which are disposed at the corners of the lowermost tier, have flat lower faces 22 (see FIG. 4) but domed or convex, preferably partspheroidal, upper faces 24 so that their upper faces 24 effectively make point contact with the lower faces of the first tier. Each disc 18 is of greatest thickness at its centre and at this point, its thickness is substantially the same as the thickness of each disc 20. Thus the discs 18 act as fulcrums, allowing universal tilting movements of the batts supported thereby in that the batts may tilt not only laterally of the fore-and-aft axis of the car but also parallel to said axis and in directions therebetween.

The discs 18, 20 may be cemented to the upper faces of the props 16 or they may be placed dry thereon. In an alternative embodiment (not illustrated), the discs 18 may be inverted relative to their position shown in FIG. 4 so that the domed face thereof contacts the upper face of the respective prop. In this latter embodiment, the discs 18 may be cemented to the lower face of the respective batts or placed dry.

Figure 5:
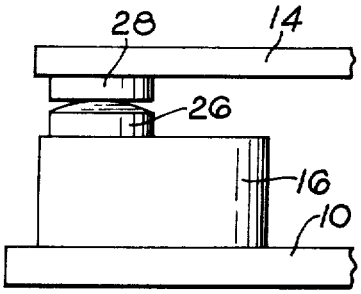
FIGS. 5 and 6 are views similar to FIG. 4 but showing modifications.
Figure 6:
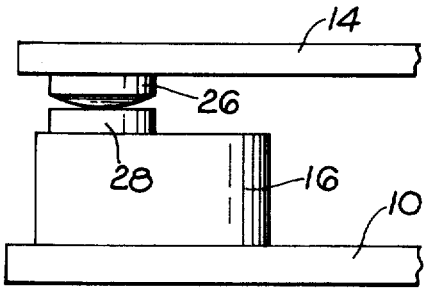

FIGS. 5 and 6 illustrate further modifications employing two discs 26, 28 at each of the four corners of the first tier of batts. One disc 28 has flat parallel faces and the other disc 26 has one flat face and one domed, preferably part-spheroidal, face, the discs being arranged with the domed face of the disc 26 in face to face contact with the adjacent face of the disc 28. The domed disc 26 may either be lowermost, as shown in FIG. 5, or uppermost, as shown in FIG. 6. One or both discs 26, 28 may be cemented to the respective batt or prop or one or both discs may be placed dry.

Whilst in the embodiments of FIGS. 1 to 6, only discs 18 and 26 at the corners of the lowermost tier have domed faces, it will be understood that the discs 20 may, if desired, also be provided with domed faces and be arranged in similar fashion to the discs 18, 26.

The remaining tiers are supported one above the other by series of cylindrical props 30 arranged in similar fashion to the props 16, each prop 30 contacting the adjacent upper and lower batts through the agency of discs 32, 34 which may be recessed and may have flat parallel faces. However, either the discs 32 or the discs 34 at the corners of each tier may each have a domed face and may be arranged in similar fashion to the discs 18, 26 used in supporting the lowermost tier. Furthermore, the discs 32 or the discs 34 at other supporting positions may each have a domed face and be arranged in similar fashion to the discs 18, 26.

I claim:

1. A kiln car comprising a wheeled base having a substantially flat horizontal upper surface and carrying a superstructure comprising a plurality of superimposed rectangular tiers each composed of at least one plate-like batt of refractory material, the tiers being vertically spaced from one another and from said base by supporting props of refractory material located at least at the four corners of the tiers, each each prop having substantially flat top and bottom surfaces, wherein the improvement comprises at least one disc of refractory material interposed between the lowermost tier and each of its supporting props, both the under side of said tier and the top of each of its supporting props having a substantially flat surface in contact with said interposed discs, and at least some of said discs having one convex side making substantially point contact with an opposing surface, and one substantially flat side.

2. A kiln car according to claim 1 wherein a disc having one convex side is interposed between the lowermost tier and each of the four props supporting the corners of said tier.

3. A kiln car according to claim 1 wherein a disc having both sides substantially flat and parallel is provided adjacent to each convex side of a disc.

4. A kiln car according to claim 1 wherein each convex side of a disc is part-spheroidal.

5. A kiln car according to claim 1 wherein each disc is composed of an alumina silicate having an alumina content of about 42%.

* * * * *